United States Patent [19]

Proctor et al.

[11] Patent Number: 4,582,217

[45] Date of Patent: Apr. 15, 1986

[54] SEALABLE FLUID CONTAINMENT ASSEMBLY

[75] Inventors: James A. Proctor, East Brunswick; Vassilios J. Livanos, Fort Lee, both of N.J.

[73] Assignee: Matheson Gas Products, Inc., Secaucus, N.J.

[21] Appl. No.: 661,576

[22] Filed: Oct. 16, 1984

[51] Int. Cl.[4] ..... B65D 25/14

[52] U.S. Cl. ..... 220/288; 220/3; 220/327

[58] Field of Search ..... 220/288, 304, 85 P, 220/85 F, 327, 3

[56] References Cited

U.S. PATENT DOCUMENTS

| | | | |
|---|---|---|---|
| 1,413,502 | 4/1922 | Steinmetz | 220/3 X |
| 2,450,630 | 10/1948 | Bourne, Jr. | 220/288 X |
| 3,074,591 | 1/1963 | Raver | 220/327 |

FOREIGN PATENT DOCUMENTS

| | | | |
|---|---|---|---|
| 1419790 | 10/1965 | France | 220/304 |
| 295038 | 12/1953 | Switzerland | 220/3 |
| 260228 | 3/1927 | United Kingdom | 220/3 |
| 432718 | 8/1935 | United Kingdom | 220/3 |

OTHER PUBLICATIONS

"Compressed Gas Cylinders", Pressed Steel Tank Co., Inc.

*Primary Examiner*—Steven M. Pollard

*Attorney, Agent, or Firm*—Dann, Dorfman, Herrell & Skillman

[57] ABSTRACT

A hermetically sealable fluid containment assembly is provided. Fluids, such as compressed gases, are typically stored in a base container having a shoulder with a neck projecting outwardly from the shoulder. In accordance with the invention, a collar member generally surrounds the neck and rests upon the shoulder of the base container. A locking arrangement is provided to securely fasten the collar member to the base container. A closure member in the form of a protective cap engages the collar member. To prevent the leakage of fluid between the collar and the base container, a seal is provided between respectively engaging surfaces of the base container and the collar. The leakage of gas between the collar member and the closure member is also prevented by a second seal disposed between respective engaging surfaces of the closure member and the collar member.

22 Claims, 2 Drawing Figures

SEALABLE FLUID CONTAINMENT ASSEMBLY

FIELD OF THE INVENTION

The present invention relates to a sealable fluid containment assembly and, more particularly, to a sealable closure assembly for containers of compressed gas.

BACKGROUND OF THE INVENTION

Compressed gases have conventionally been shipped in cylindrical containers having a valve assembly disposed within a neck portion of the container to regulate the flow of gas from the container. In the prior art, to prevent damage to the valve assembly during transit, protective caps have been inserted over the neck of the container so that the valve assembly is safely enclosed within the protective caps. Openings have been provided through the sidewall of the protective caps in order to prevent a possible pressure build-up of compressed gas within the protective cap. If, for example, the valve assembly develops a leak during transit, the leaking gas is simply vented to the atmosphere through the opening through the protective cap.

It is known that even routine handling of the gas cylinders can occasionally result in the leakage of gas from the valve assembly. Through handling and shipment of the cylinders, it is possible for a valve assembly to loosen in the neck of the cylinder or for the valve seat to be opened slightly by vibration or otherwise become damaged producing a small gas leak from the gas cylinder. Although the occasional or even sporadic leakage of relatively innocuous gases from a cylinder can be tolerated, a severe health hazzard may result when the leakage of highly toxic gases, such as arsine and phosphine, occur creating a greater concern. One factor contributing to the concern is that the rapid expansion of the electronics industry has resulted in a sharp increase in the shipment of highly toxic gases of the types mentioned above used in the manufacture of semiconductor devices.

If a leakage of a highly toxic gas develops from a conventional gas cylinder during transit, the leaking cylinder must be immediately isolated to prevent possible exposure of human beings to the toxic gas. Once the leaking container is secured in an isolated environment, trained personnel and safety equipment must be immediately transported to the location of the gas cylinder in order to detoxify, confine or collect the leaking gas. Since time delays often occur in transporting the requisite personnel and safety equipment to the location of the leaking cylinder, significant health risks could be involved. As a result, the transportation and shipment of compressed gases of a highly toxic nature necessitates the implementation of special handling procedures and safety precautions. Since small amounts of a toxic gas, such as arsine, can be extremely lethal, it is of the utmost importance to prevent the possible leakage of toxic gases from their pressurized shipping containers.

In accordance with the present invention, a sealable fluid containment assembly is provided which effectively and efficiently prevents the possible leakage of compressed gas from a base container such as a gas cylinder. The assembly in accordance with the present invention functions to hermetically seal the base container and relieve stresses at a neck portion of the base container which may be produced by external forces on the neck portion or valve assembly resulting, for example, from inadvertent dropping or mishandling of the container.

SUMMARY OF THE INVENTION

In accordance with the present invention, a sealable fluid containment assembly is provided which prevents the leakage of fluid to atmosphere from a base container such as the leakage of gas from a gas cylinder. The fluid containment assembly comprises a base container with a generally hollow interior for the containment of fluids. The base container includes a shoulder portion and a neck projecting outwardly from the shoulder to provide an opening for the container. The neck portion provides a fluid passageway to the hollow interior of the base container. The shoulder portion of the base container surrounding the neck portion includes an abutment surface which encircles the periphery of the neck portion.

A collar member is provided for the neck and is adapted to encircle the neck so that the collar member rests upon the shoulder of the base container. Locking means is provided for securely fastening the collar member to the base container. The collar member also includes a shoulder-engaging surface generally conforming to the shape of the abutment surface of the shoulder of the base container. The shoulder-engaging surface functions to engage and mate with the abutment surface around the outer periphery of the neck. The collar member is also provided with a contact surface encircling the opening provided through the neck of the container.

The fluid containment assembly also includes first sealing means disposed between the shoulder-engaging surface of the collar member and the abutment surface of the shoulder to seal the collar member with the shoulder portion of the base container.

A closure member is employed for sealably closing the opening into the base container. The closure member includes an inner generally hollow fluid containment cavity and a collar-engaging portion for engaging the collar member to retain the closure member in position on the collar member. The closure member also includes a mating collar-engaging contact surface generally conforming to the shape of the contact surface of the collar for engaging the contact surface encircling the opening to the container.

Second sealing means is disposed between the mating collar-engaging contact surface of the closure member and the contact surface of the collar member for sealing the closure member with said collar member so that the opening into the hollow interior of the base container is hermetically sealed.

BRIEF DESCRIPTION OF THE DRAWINGS

The foregoing summary, as well as the following detailed description of the preferred embodiment of the present invention, will be better understood when read in conjunction with the accompanying drawings, in which.

DESCRIPTION OF THE PREFERRED EMBODIMENT

Figure 1:
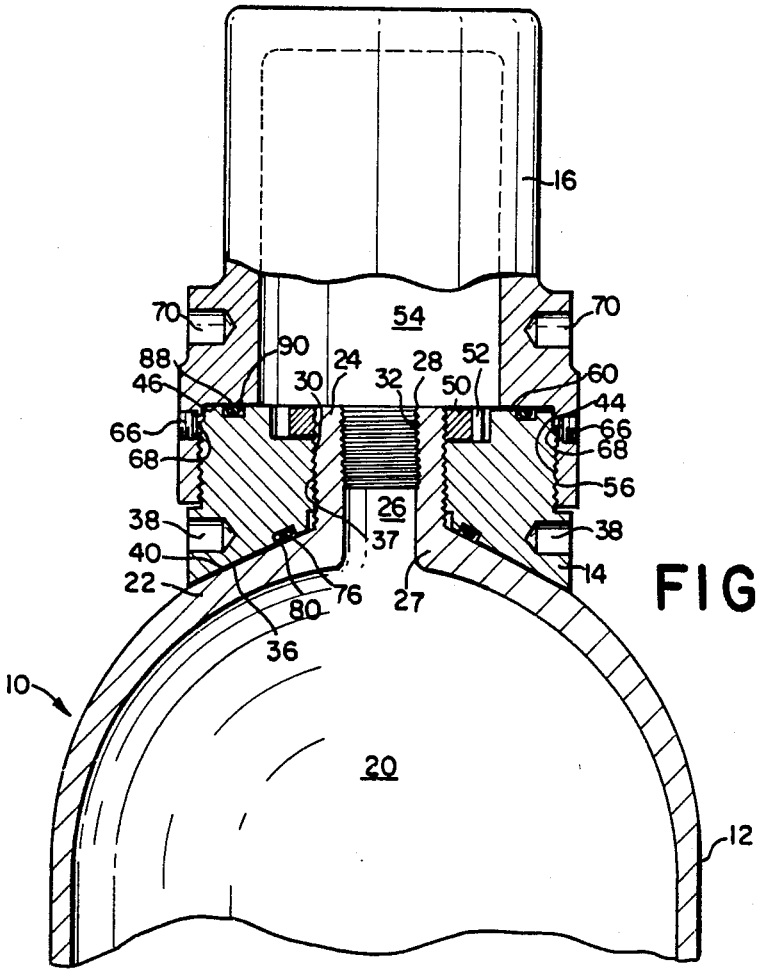
FIG. 1 is a side elevational view partially in section with part of the base container broken away showing the sealable fluid containment assembly in accordance with the present invention.
Figure 2:
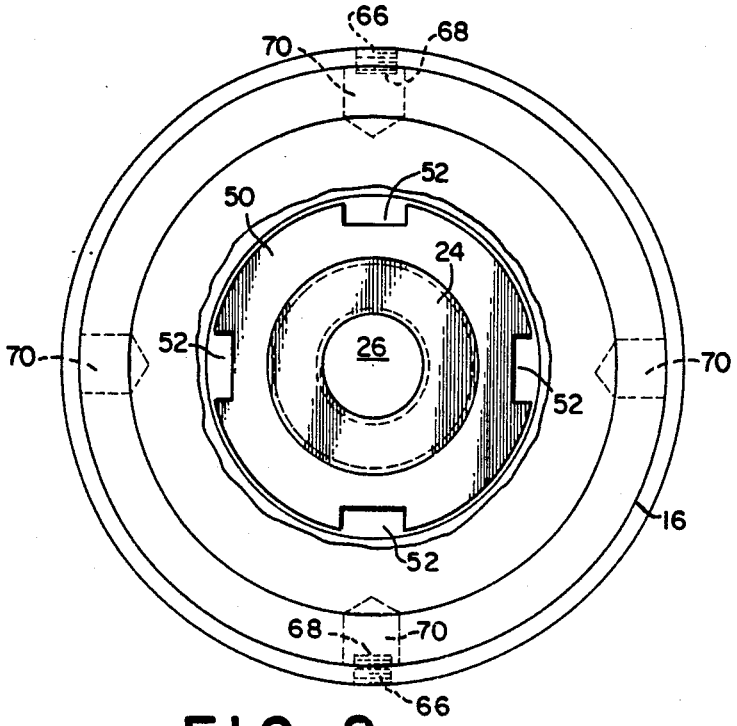
FIG. 2 is an enlarged plan view with part of the top of the closure member broken away to show the fluid containment assembly illustrated in FIG. 1.

Referring to FIGS. 1 and 2, a sealable fluid containment assembly, generally designated 10, is provided for preventing the leakage of fluids. The fluid containment assembly 10 includes a base container 12 which functions as a storage vessel for the fluid such as compressed gas, a collar member 14, and a closure member 16 which functions as a protective cap or cover over an opening 26 into the base container.

The base container 12 is a generally cylindrical, enclosed vessel having a generally hollow interior 20 for the containment of fluids, such as compressed gas. To withstand the stresses resulting from the storage of compressed gas under relatively high pressures, the vessel 12 is preferably constructed of a rigid metallic material such as stainless steel or carbon steel. Other metals, such as aluminum or nickel, may also be used in forming the vessel depending on the nature and properties of the vessel needed for the particular gas being stored.

The generally cylindrical vessel 12 is provided with an outer shoulder portion 22 and a generally tubular neck portion 24 which projects outwardly from the shoulder of the vessel and provides the opening or fluid passageway 26 through the hollow interior of the neck communicating with the hollow interior 20 of the vessel. The neck 24 has a base end 27 joined to the shoulder 22 of the vessel and a free end or mouth end 28. The shoulder 22 and neck 24 of the vessel are structurally adapted to preferably have walls with a greater thickness than the walls of the main body of the vessel 12. An increased wall thickness is preferably employed at the shoulder portion 22 and neck portion 24 of the vessel in order to strengthen those portions of the vessel and thereby reduce potential effects of shear forces to the neck or to minimize the possibility of the neck bending or shearing if the container is dropped or mishandled during shipment or movement of the vessel causing forces acting on the neck portion.

The generally tubular neck 24 of the vessel is positioned so that its central axis is disposed coaxially with the longitudinal axis of the cylindrical vessel 12. In an alternate configuration the threads may extend only a portion of the length of the neck and be located at the mouth end 28 of the neck. The neck 24 has a threaded outer generally cylindrical surface 30 with the threads extending from the base end 27 of the neck at shoulder 22 to the mouth end 28 of the neck. The neck also includes a generally cylindrical threaded inner surface 32, which extends from the mouth end 28 of the neck into the interior of the neck toward the hollow interior 20 of the vessel 12. The internally threaded opening in the neck portion is provided so that a valve assembly (not shown) can be screwed into the neck 24 of the vessel 12 in order to control and regulate the flow of the compressed gas from the vessel. In this arrangement, the valve assembly functions to seal the opening into the hollow interior of the vessel and provides a means to regulate the release of compressed gas from the container.

The shoulder 22 of the vessel 12 is formed to provide an outer abutment surface 36, which is flat in cross-section, encircling the outer periphery of the neck along the portion of the shoulder generally adjoining the base end of the neck. The abutment surface 36 extends from the base end of the neck outwardly along the shoulder of the vessel and is configured to preferably provide a smooth annular contacting surface for collar member 14. As illustrated in FIG. 1, the abutment surface 36 is depicted with a frusto-conical shape centered about the longitudinal axis of vessel 12 and neck 24. Since conventional gas cylinders have generally rounded shoulders, the frusto-conical abutment surface provided on the shoulder 22 of vessel 12 may be machined onto the rounded shoulders of a conventionally shaped gas cylinder.

The collar member 14 of the assembly is preferably a generally annular member constructed of a rigid material, preferably low alloy carbon steel, for placement over the neck 24 of vessel 12. The collar member is adapted to rest upon the shoulder of the vessel and is adapted to provide support to the neck and shoulder of vessel 12. The collar member 14 functions to relieve forces acting on the neck and shoulder of the vessel and, in particular, reduces bending and shearing forces placed on the neck 24 of the vessel, for example, when the vessle is inadvertantly dropped or mishandled.

The collar member 14 encircles the neck portion of vessel 12 and locking means is provided for securely fastening the collar member to the base container. As shown in FIG. 1, the locking means is provided by having an inner passage defining surface 37 through the collar threaded to mesh with the outer threaded surface 30 of the neck, so that the collar member can be securely screwed onto the neck 24 until the collar member 14 rests upon the shoulder 22 of vessel 12.

The conventional valve assembly (not illustrated) used with gas cylinders typically projects outwardly from the mouth end 28 of the neck and is usually wider than the outer cylindrical surface of neck 24. As a result, the collar member 14 is screwed onto the neck 24 prior to the insertion of the valve assembly into the neck.

To ensure that the collar member is tightly secured onto the neck of vessel 12, the collar member includes diametrically opposed cavities 38 along its outer periphery adapted to receive a spanner wrench. When screwed into position on the neck 24 of vessel 12, the collar member 14 is adapted to abut the shoulder 22 of the vessel 12. In this arrangement, the collar member 14 includes a shoulder-engaging surface 40 which is shaped to generally mate and conform to the shape of the abutment surface 36 provided on the exterior surface of the shoulder 22. To uniform to the shape of the abutment surface 36 of the shoulder 22, the shoulder-engaging surface is a generally frusto-conical in shape and is adapted to engage most, if not all, of the abutment surface of the shoulder of the vessel. The frusto-conical shape of these mating contacting surfaces provides a greater contact area between the collar member and the shoulder of the vessel. An increased surface area of contact between the collar and shoulder is desirable in providing additional support for the neck of the vessel. To properly distribute stresses away from the neck 24, the collar is tightened onto the exterior surface of the neck until the shoulder-engaging surface 40 firmly engages the abutment surface 36 provided on the shoulder 22 of the vessel.

To assure secure fastening of the collar member 14 to the neck 24 of the vessel, the lock means further includes a lock nut 50. An increased diameter annular recess 52 is provided in the central opening through the collar member foreshortening the threaded inner cylindrical surface 30 of the opening through the collar member to expose a portion of the threaded outer surface 37 of the neck at the mouth end 28 of the neck, when collar member 14 is securely threaded on the neck 24. In this arrangement, an annular channel is formed by the recess around the free end of the neck 24 so that the locking nut 50 can be screwed onto the external threads of the neck 24 to tightly secure and further lock the collar member in the desired position on the neck and in engagement with the abutment surface of the shoulder.

The collar member 14 also functions to retain and support closure member 16. For this purpose, the collar member includes a generally cylindrical outer surface having an externally threaded portion 44 for receiving closure member 16. The collar member also includes a generally planar contact surface 46, which is generally transverse to the central axis of the annular collar member 14 and generally transverse to the longitudinal axis of the neck 24 of vessel 12 when the collar member 14 is threaded on the neck. As illustrated in FIG. 1, the contact surface 46 has a generally annular shape and is shown to be coplanar with the mouth end 28 of the neck 24. The contact surface 46 extends from the peripheral surface of the collar member 14 radially inward to the recess 52 around the central opening through the collar member. The contact surface 46 functions to provide an abutment and sealing surface for closure member 16.

The closure member 16 of the assembly is provided to enclose the opening 26 through the neck leading to the hollow interior 20 of the vessel and to cover and shield the valve assembly (not illustrated) disposed within the neck. As illustrated in FIG. 1, the closure member is in the form of a generally cylindrical cup-shaped cap having a generally cylindrical fluid containment cavity or chamber 54, which receives the valve assembly protruding from the neck of the vessel. To withstand pressure and stress, the closure member is constructed of a rigid material, such as carbon steel. The closure member 16 is supported on the collar member 14 and includes collar-engaging portion for engaging the collar member to retain the closure member on the collar. As depicted in FIG. 1, the closure member is provided with an enlarged recess opening leading into the cavity 54 having a threaded inner cylindrical surface 56, which is adapted to mesh with the outer threaded surface 44 of the collar member 14, so that the closure member can be screwed onto the collar member and held in place.

It should be appreciated that the collar member and closure member could be secured or held together by arrangements other than having the closure member provided with the internally threaded collar engaging portion. For example, the collar and closure members could be provided with radially extending flanges, which are located together on opposite sides of the structure.

The closure member 16 also includes a collar-engaging surface 60 which is provided by the inner annular end of the enlarged recess in the closure member and is formed to generally conform to the planar annular contact surface 46 on collar member 14. The collar-engaging surface 60 is preferably recessed into the cavity 54 in the closure member to inhibit marring of the surface through the handling of the closure member. The collar-engaging surface is provided in a plane generally transverse to the inner generally threaded cylindrical surface 56 of the collar member. The collar-engaging surface is adapted to preferably engage the entire contact surface 46 of the collar around the central opening in the collar. It is desired that a sufficient surface area of contact between the collar-engaging surface 60 of the closure member and the contact surface 46 of the collar member be provided to relieve or reduce potential stress on the closure member, and particularly on the threaded surfaces 44 and 56 of the collar member and the closure member respectively, when the closure member is subjected to undesired external forces, or, for example, when the container assembly falls striking the closure.

To tightly secure the closure member on the collar member, holding means is provided for locking the closure member on the collar member. More specifically, the holding means is provided by set screws 66 which securely lock the closure member in position on the collar member. The closure member includes threaded passageways extending through the closure member into communication with the collar member 14. The set screws are threaded into the threaded passageways to tightly engage the outer threaded surface 44 of the collar member 14 to lock the closure member in position. To prevent any damage to the threads of the collar members, deformable disc members 68, preferably constructed of annealed copper, are inserted into the passageways and placed between the set screws 66 and the outer threaded surface 44 of the collar member 14. The deformable disc members function to deform on the threads of the collar member to prevent damage to the threads when the set screws are tightly screwed into place.

To ensure that the closure member 16 is tightly secured to the collar member 14 before the set screws 66 are employed to lock the closure member in place, the closure member includes diametrically opposed cavities 70 along its outer periphery to receive a spanner wrench to securely tighten the closure member on the collar member.

As previously mentioned, gas may leak from and/or around the valve assembly (not shown) in the neck of the container. To prevent the leakage of gas to atmosphere from the chamber 54 in the closure member 16, it is important to hermetically seal the passages between the closure member and the collar member and the collar member and vessel 12, so that whenever gas inadvertently leaks from the vessel 12 into chamber 54 of the closure member, the gas is not thereafter released to the atmosphere. The leakage of gas into chamber 54 of the closure member can result, for example, from a malfunction of the valve assembly. Leakage of gas into chamber 54 can also occur as a result of the valve assembly working itself loose in the opening 26 through the neck 24 of the vessel. The sealing of the containment assembly is particularly important when compressed gas of a toxic nature is in the vessel.

For the purpose of sealing the collar member 14 with vessel 12, first sealing means is disposed between the shoulder-engaging surface 40 of the collar member and the contacting abutment surface 36 of the shoulder. The seal means is preferably provided by an O-ring type of seal 76, although various seals may also be utilized. To seal the respective surfaces, the collar member 14 is screwed tightly onto the neck 24 of the vessel so that the shoulder-engaging surface 40 of the collar member 14 tightly engages and contacts the abutment surface 36 of the shoulder 22 so that a fluid or gas tight seal is formed between the collar member and the shoulder. As illustrated in FIG. 1, an annular recess 80 is provided between the shoulder-engaging surface 40 of the collar member and the abutment surface 36 of the shoulder, so that the seal 76 may be inserted into the recess. As illustrated in FIG. 1, the recess 80 is provided in the collar member 14 along the shoulder-engaging surface 40 of the collar member. To effect a proper seal, the O-ring should be somewhat thicker than the depth of the recess 80 so that the O-ring seal is compressed within the recess to form a tight seal between the collar member and the shoulder of vessel 12.

In order to hermetically seal the containment assembly, it is also necessary to provide a seal between the closure member 16 and the collar member 14. For this purpose, second sealing means in the form of an O-ring type seal 88 is disposed between the collar-engaging surface 60 of the closure member 16 and the engaging contact surface 46 of the collar member 14. To effect the desired seal between the collar member and the closure member, a generally annular recess 90 is provided between the collar-engaging surface 60 and the contact surface 46 to receive the O-ring seal 88. As specifically illustrated in FIG. 1, the recess 90 is provided on the collar member 14 in the contact surface 46 of the collar member. The O-ring seal 88 is placed within the recess and compressed between the collar member 14 and the closure member 16 to form a gas tight seal therebetween. As with O-ring seal 76, the O-ring seal 88 should be somewhat thicker than the depth of the recess 90 so that the O-ring seal is compressed when the collar-engaging surface and the contact surface are pressed into tight engagement with one another. The compression of the O-ring seal tightly seals the closure member with the collar member.

Once the assembly is sealed together, any gas leaking from the base container into the chamber 54 of the closure member 16 will be trapped within the chamber 54. Seals 76 and 88 function to hermetically seal the closure member 16, the collar member 14 and the base container 12 together to protect from gas leaking to the atmosphere.

From the foregoing description and the accompanying figures, it can be seen that the present invention provides a sealable fluid containment assembly which prevents the leakage of fluids, such as compressed gas, from a vessel into the atmosphere. The design can be utilized to maintain a gas-tight seal even when pressurized in the range of 1000–1600 psig or higher. The gas-tight seal is achieved without welding any of the components together, since welding could result in the alteration of the structural properties of the vessel 12, the collar member and the closure member. The containment assembly is designed so that assembly preferably has impact strength of up to 4,000,000 psi when dropped on the closure at an impact angle of 45°. A maximum shear stress of 40,000 psi is desired to be withstood by the neck with the collar and closure members in place. The closure member and the collar member are preferably designed to withstand a maximum at least 1600 psi as a pressure vessel. In this configuration, the closure member may have a thickness of 0.237 inches when made of carbon steel. It will be recognized by those skilled in the art that changes or modifications may be made without departing from the broad inventive concepts of the invention. It is understood, therefore, that the invention is not limited to the particular embodiment described herein, but is intended to cover all changes and modifications which are within the scope and spirit of the invention as set forth in the appended claims.

What is claimed is:

1. A hermetically sealable fluid containment assembly comprising:

(A) a base container having a generally hollow interior for the containment of fluids, the base container having a shoulder portion and a neck portion projecting outwardly from the shoulder portion to provide an opening for the container, the shoulder portion having an outer abutment surface encircling the neck portion;

(B) a collar member encircling the neck portion and having a shoulder-engaging surface generally conforming to the shape of the abutment surface of the shoulder portion for engaging and mating with the abutment surface, the shoulder-engaging surface being configured to provide a surface area of contact between the shoulder-engaging surface and the abutment surface sufficient to distribute stresses away from the neck and to reduce stresses tending to separate the collar member from the base container, said collar member portion having an outer contact surface with an opening providing access to the opening for the container;

(C) locking means for securely fastening the collar member to the base container;

(D) first sealing means disposed between a portion of the shoulder-engaging surface of said collar member and a portion of the abutment surface of the shoulder portion for sealing the collar member with the shoulder portion;

(E) a closure member for sealably closing the opening into the base container, the closure member having a collar-engaging portion for engaging the collar member for use in retaining the closure member on the collar and having a collar-engaging surface generally conforming to the shape of the contact surface of the collar for engaging and mating with the contact surface and configured to provide a surface area of contact between the collar-engaging surface and the contact surface sufficient to reduce stress tending to separate the closure member from the collar member; and (F) second sealing means disposed between a portion of the collar-engaging surface of the closure member and a portion of the contact surface of the collar member for sealing the closure member with said collar member so that the opening into the hollow interior of the base container is hermetically sealed.

2. The assembly set forth in claim 1 wherein said neck is generally tubular and the locking means comprises a generally cylindrical threaded outer surface on the neck portion and a generally cylindrical threaded inner surface on the collar member adapted to mate with the threaded outer surface of the neck so that the collar member screws onto the neck to securely fasten the collar member to the base container.

3. The assembly set forth in claim 2 wherein the locking means further comprises a lock nut having a generally cylindrical threaded inner surface adapted to mate with the threaded outer surface of the neck so that the locking nut screws onto the neck and engages the collar member to lock the collar member into position on the neck.

4. The assembly set forth in claim 1 wherein said neck is generally cylindrical and has a threaded portion around its outer end, the locking means comprising a lock nut having a generally threaded inner surface adapted to mate with the threaded portion of the neck so that the locking nut screws onto the neck and engages the collar member to lock the collar member into position on the neck.

5. The assembly set forth in claim 1 comprising holding means engageable with the closure member and the collar member for locking the closure member in sealed position with the collar member.

6. The assembly set forth in claim 5 wherein the holding means comprises at least one set screw and the closure member includes at least one threaded passageway extending through the closure member into communication with the collar member so that the set screw is insertable into the threaded passageway to engage the collar member to lock the closure member in sealed position with the collar member.

7. The assembly set forth in claim 1 wherein said collar member is generally annular in shape and includes a threaded generally cylindrical outer surface and wherein said closure member comprises a mating generally cylindrical threaded inner surface to mesh with the threaded outer cylindrical surface of the collar member so that the closure member screws onto the collar member.

8. The assembly set forth in claim 7 comprising holding means for locking the closure member into screwed position on the collar member.

9. The assembly set forth in claim 8 wherein said holding means comprises at least one set screw and the closure member includes at least one threaded passageway extending through the closure member into communication with the collar member so that the set screw is insertable into the threaded passageway to engage the collar member to lock the closure member in sealed position with the collar member.

10. The assembly set forth in claim 9 comprising a deformable member insertable into the threaded passageway intermediate the set screw and the threaded outer cylindrical surface of the collar member to generally deform to the shape of the threaded outer cylindrical surface of the collar member to prevent damage to the threaded outer surface of the collar member when the set screw locks the closure member with the collar member.

11. The assembly set forth in claim 1 wherein the closure member includes a generally hollow interior cavity and the collar-engaging surface is recessed a distance into the hollow interior cavity of the closure member.

12. The assembly set forth in claim 1 wherein the collar-engaging surface of the closure member and the contact surface of the collar member are generally planar to abut one another.

13. The assembly set forth in claim 12 wherein the collar-engaging surface and the contact surface are generally annular in shape.

14. The assembly set forth in claim 13 wherein one of the collar-engaging surface and the contact surface includes a generally annular recess disposed between the collar-engaging surface and the contact surface and wherein the second sealing means comprises an O-ring seal disposed in the recess having a thickness greater than the depth of the recess so that the O-ring seal is compressed within the recess to form a seal between the collar-engaging surface and the contact surface.

15. The assembly set forth in claim 14 wherein the recess is provided on the collar-engaging surface of the closure means.

16. The assembly set forth in claim 1 wherein the collar-engaging surface of the closure member and the contact surface of the collar member are configured to provide the surface area of contact therebetween sufficient to reduce stresses between the closure member and the collar member produced by external forces acting on the closure member.

17. The assembly set forth in claim 1 wherein said shoulder-engaging surface of said collar member and the abutment surface of the shoulder are generally frusto-conical in shape.

18. The assembly set forth in claim 17 wherein one of the shoulder-engaging surface and the abutment surface includes a generally annular recess disposed between the shoulder-engaging surface and the abutment surface and wherein the first sealing means comprises an O-ring seal disposed in the recess having a thickness greater than the depth of the recess so that the O-ring seal is compressed within the recess to form a seal between the shoulder-engaging surface and the abutment surface.

19. The assembly set forth in claim 18 wherein the recess is provided in the shoulder-engaging surface of the collar member.

20. The assembly set forth in claim 1 wherein the shoulder-engaging surface of the collar member and the abutment surface of the shoulder are configured to provide the surface area of contact therebetween extending from a base end of the neck outwardly along the shoulder to reduce stresses on the neck produced by external forces acting on the closure member.

21. The assembly set forth in claim 1 wherein said first sealing means is disposed between an intermediate portion of the shoulder-engaging surface and an intermediate portion of the abutment surface, said shoulder-engaging surface and said abutment surface being configured to provided said surface area of contact therebetween on opposite sides of said first sealing means.

22. The assembly set forth in claim 1 wherein said second sealing means is disposed between an intermediate portion of said collar-engaging surface and an intermediate portion of said contact surface, said collar-engaging surface and said contact surface being configured to provide said surface area of contact therebetween on opposite sides of said second sealing means.

* * * * *

UNITED STATES PATENT AND TRADEMARK OFFICE

CERTIFICATE OF CORRECTION

PATENT NO. : 4,582,217

DATED : April 15, 1986

INVENTOR(S) : James A. Proctor and Vassilios J. Livanos

It is certified that error appears in the above—identified patent and that said Letters Patent is hereby corrected as shown below:

Column 4, line 21, change "vessle" to --vessel--;
line 48, change "uniform" to --conform--.

Column 7, line 3, after "along" insert --an intermediate portion of--;
line 8, after "vessel 12." insert --As shown in Fig. 1, the shoulder-engaging surface 40 and the abutment surface 36 mate and contact each other on opposite sides of the recess 80 and the enclosed O-ring.--;
line 21, delete "in" and insert --along an intermediate portion of--;
line 31, after "collar member" insert --and as illustrated in Fig. 1, the collar-engaging surface and the contact surface mate and contact each other on opposite sides of the recess 90 and the enclosed O-ring--.

Claim 21, line 6, change "provided" to --provide--.

Signed and Sealed this

*Twenty-third* Day of *September 1986*

[SEAL]

*Attest:*

DONALD J. QUIGG

*Attesting Officer*

*Commissioner of Patents and Trademarks*